US005517823A

United States Patent [19]

Andeen et al.

[11] Patent Number: 5,517,823

[45] Date of Patent: May 21, 1996

[54] PRESSURE CONTROLLED CRYOPUMP REGENERATION METHOD AND SYSTEM

[75] Inventors: Bruce R. Andeen, Boxborough; Gerald J. Fortier, Plainville; Allen J. Bartlett, Milford; Michael J. Eacobacci, Randolph; Philip C. Lessard, Boxborough, all of Mass.

[73] Assignee: Helix Technology Corporation, Mansfield, Mass.

[21] Appl. No.: 374,140

[22] Filed: Jan. 18, 1995

[51] Int. Cl.[6] ..... B01D 8/00

[52] U.S. Cl. ..... 62/55.5; 417/901

[58] Field of Search ..... 62/55.5; 417/901

[56] References Cited

U.S. PATENT DOCUMENTS

| | | | |
|---|---|---|---|
| 4,356,701 | 11/1982 | Bartlett et al. | 62/55.5 |
| 4,555,907 | 12/1985 | Bartlett | 66/55.5 |
| 4,757,689 | 7/1988 | Bachler et al. | 62/55.5 |
| 4,918,930 | 4/1990 | Gaudet et al. | 62/55.5 |
| 5,176,004 | 1/1993 | Gaudet | 62/55.5 |

FOREIGN PATENT DOCUMENTS

| | | |
|---|---|---|
| 0558495 | 4/1994 | European Pat. Off. . |
| 93/05294 | 3/1993 | WIPO . |

OTHER PUBLICATIONS

Mundinger, H. J., et al., "Fast Cryopump Regeneration Does More Than Save Time," *Semiconductor International*, pp. 154–156 (1993, Jul.).

Mundinger, H. J., et al., "A New Cryopump with a Very Fast Regeneration System," *Vacuum*, pp. 545–549 (1992).

*Primary Examiner*—Ronald C. Capossela
*Attorney, Agent, or Firm*—Hamilton, Brook, Smith & Reynolds

[57] ABSTRACT

In a subatmospheric regeneration process, a relief valve and a roughing valve are coupled in parallel to a common roughing pump. During regeneration, the cryopump is warmed to release gases from cryopump stages. The relief valve opens at a first cryopump pressure level less than a predetermined maximum pressure. The maximum pressure is subatmospheric. The relief valve closes when the cryopump pressure drops below a second cryopump pressure level. Pressure in a line between the relief valve and the roughing pump is monitored to control the opening of the roughing valve to the roughing pump.

19 Claims, 6 Drawing Sheets

PRESSURE CONTROLLED CRYOPUMP REGENERATION METHOD AND SYSTEM

BACKGROUND OF THE INVENTION

Cryogenic vacuum pumps, or cryopumps, currently available generally follow a common design concept. A low temperature array, usually operating in the range of 4 to 25 K., is the primary pumping surface. This surface is surrounded by a higher temperature radiation shield, usually operated in the temperature range of 60 to 130 K., which provides radiation shielding to the lower temperature array. The radiation shield generally comprises a housing which is closed except a frontal array positioned between the primary pumping surface and a work chamber to be evacuated.

In operation, high boiling point gases such as water vapor are condensed on the frontal array. Lower boiling point gases pass through that array and into the volume within the radiation shield and condense on the lower temperature array. A surface coated with an adsorbent such as charcoal or a molecular sieve operating at or below the temperature of the colder array may also be provided in this volume to remove the very low boiling point gases such as hydrogen. With the gases thus condensed and/or adsorbed onto the pumping surfaces, a vacuum is created in the work chamber.

In systems cooled by closed cycle coolers, the cooler is typically a two-stage refrigerator having a cold finger which extends through the rear or side of the radiation shield. High pressure helium refrigerant is generally delivered to the cryocooler through high pressure lines from a compressor assembly. Electrical power to a displacer drive motor in the cooler is usually also delivered through the compressor or a controller assembly.

The cold end of the second, coldest stage of the cryocooler is at the tip of the cold finger. The primary pumping surface, or cryopanel, is connected to a heat sink at the coldest end of the second stage of the cold finger. This cryopanel may be a simple metal plate or cup or an array of metal baffles arranged around and connected to the second-stage heat sink. This second-stage cryopanel also supports the low temperature adsorbent.

The radiation shield is connected to a heat sink, or heat station, at the coldest end of the first stage of the refrigerator. The shield surrounds the second-stage cryopanel in such a way as to protect it from radiant heat. The frontal array is cooled by the first-stage heat sink by attachment to the radiation shield or, as disclosed in U.S. Pat. No. 4,356,810, through thermal struts.

After several days or weeks of use, the gases which have condensed onto the cryopanels, and in particular the gases which are adsorbed, begin to saturate the cryopump. A regeneration procedure must then be followed to warm the cryopump and thus release the gases and remove the gases from the system. As the gases evaporate, the pressure in the cryopump increases, and the gases are exhausted through a relief valve. During regeneration, the cryopump is often purged with warm nitrogen gas. The nitrogen gas hastens warming of the cryopanels and also serves to flush water and other vapors from the cryopump. Nitrogen is the usual purge gas because it is relatively inert, and is available free of water vapor. It is usually delivered from a nitrogen storage bottle through a transfer line and a purge valve coupled to the cryopump.

After the cryopump is purged, it must be rough pumped to produce a vacuum around the cryopumping surfaces and cold finger which reduces heat transfer by gas conduction and thus enables the cryocooler to cool to normal operating temperatures. The roughing pump is generally a mechanical pump coupled through a fluid line to a roughing valve mounted to the cryopump.

The typical regeneration process takes several hours during which the manufacturing or other process for which the cryopump creates a vacuum must idle. In most systems, it is only the second stage which requires regeneration. Therefore, partial regeneration processes have been used in which the second stage is warmed to release gases from only that stage as the refrigerator continues to operate to prevent release of gases from the first stage. It is critical that gas not be released from the first stage because that gas would contaminate the warm second stage, and such contamination would require that the cryopump receive a full regeneration cycle. Since the refrigerator continues to operate and the cryopanels remain at relatively cool temperatures, the cool down time after the partial regeneration process is significantly less than that of a full regeneration.

Control of the regeneration process is facilitated by temperature sensors coupled to the cold finger heat stations. Thermocouple pressure gauges have also been used with cryopumps. Although regeneration may be controlled by manually turning the cryocooler off and on and manually controlling the purge and roughing valves, a separate regeneration controller is used in more sophisticated systems. Wires from the controller are coupled to each of the sensors, the cryocooler motor and the valves to be actuated. A cryopump having an integral electronic controller is presented in U.S. Pat. No. 4,918,930.

In some cryopump applications, it is desirable to maintain a subatmospheric pressure condition within the cryopump during regeneration. For example, certain types of high vacuum isolation valves, such as poppet valves, will open during the positive pressure period of a typical regeneration process when gases are vented through a relief valve. Unintentional opening of the isolation valve is potentially detrimental to a process application due to contamination of the work space by regenerated gases.

DISCLOSURE OF THE INVENTION

The present invention relates to a method of regeneration of a cryopump, and particularly subatmospheric regeneration, and the electronics for controlling that regeneration process.

One aspect of the present invention relates to coupling a subatmospheric relief valve and a roughing valve in parallel to a common roughing pump for subatmospheric regeneration of a cryopump. The relief valve and the roughing valve are each coupled to the cryopump.

Another aspect of the present invention relates to monitoring the closing of the subatmospheric relief valve to control the opening of the roughing valve to the roughing pump. In accordance with the invention, pressure in a line between the relief valve and the roughing pump is monitored. After the line pressure has dropped sufficiently to indicate that the relief valve has closed, the roughing valve may be opened.

In the preferred regeneration method of the present invention, the cryopump is warmed to release gases from the cryopanels. In a full regeneration, the cryopump may be warmed by heating the first and second stages and by applying purge gas to the cryopump chamber. In a partial regeneration, only the second stage is heated. As the cryopump pressure rises, a relief valve opens to couple the cryopump chamber to a roughing pump. The valve opens at a first cryopump pressure level less than a predetermined maximum pressure which is subatmospheric, preferably within the range of about 520 to 600 torr. The relief valve is. preferably a pressure-responsive relief valve which is maintained open until the cryopump is sufficiently empty of released gases drawn off by the roughing pump. When the cryopump pressure is drawn below a second cryopump pressure level, the relief valve closes. The relief valve may be determined to be closed by monitoring the pressure in the line between the relief valve and the roughing pump and detecting when the line pressure drops to approximately 1 torr.

Once the relief valve is determined to be closed in the prior step, indicating that the cryopump is sufficiently empty of released gases, the roughing valve is opened to the roughing pump to reduce the cryopump pressure to a base pressure level. After the roughing valve is opened, warming of the cryopump may be stopped.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF PREFERRED EMBODIMENT

Figure 1:
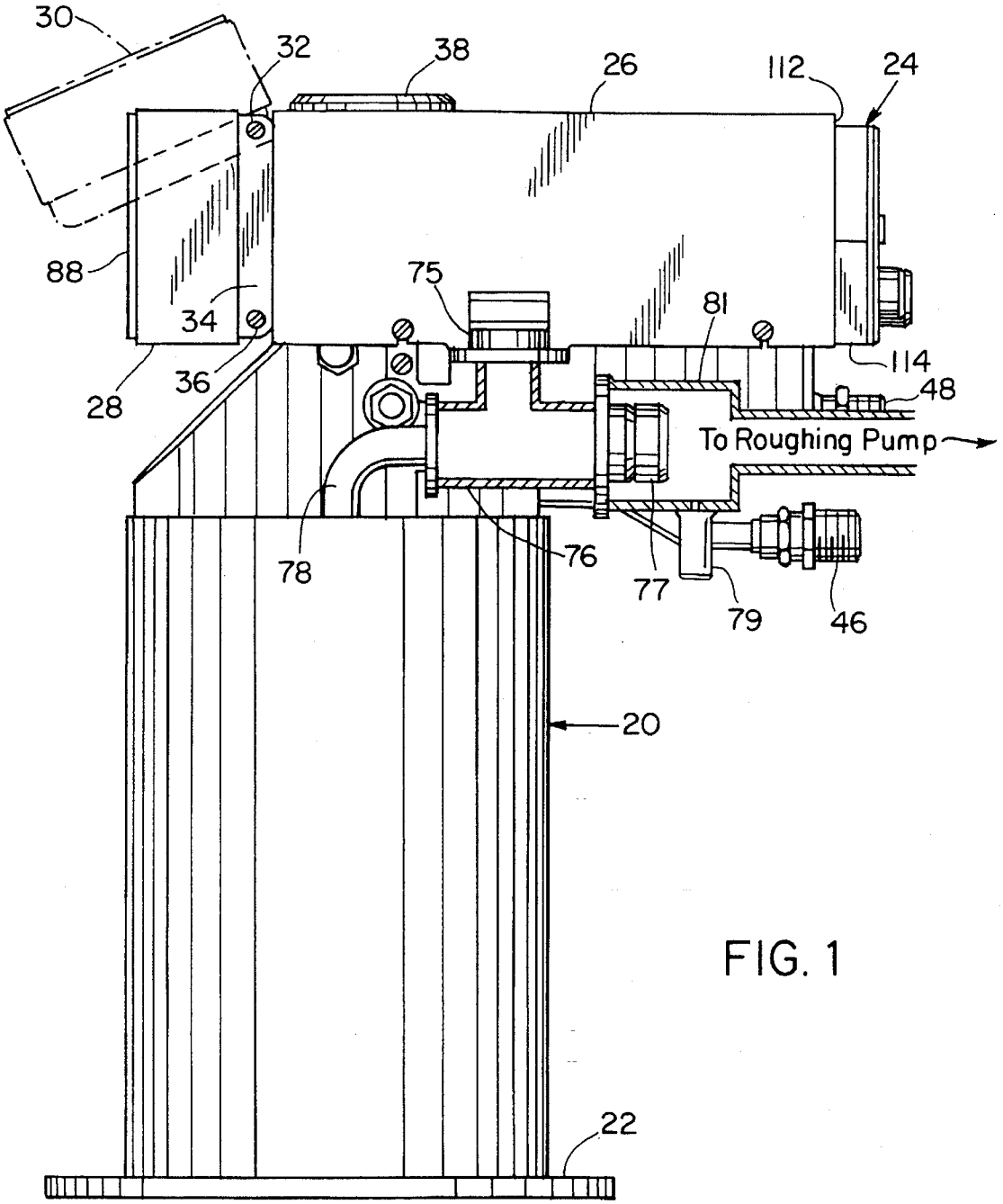
FIG. 1 is a side view of a cryopump embodying the present invention.

FIG. 1 is an illustration of a cryopump embodying the present invention. The cryopump includes the usual vacuum vessel 20 which has a flange 22 to mount the pump to a system to be evacuated. In accordance with the present invention, the cryopump includes an electronic module 24 in a housing 26 at one end of the vessel 20. A control pad 28 is pivotally mounted to one end of the housing 26. As shown by broken lines 30, the control pad may be pivoted about a pin 32 to provide convenient viewing. The pad bracket 34 has additional holes 36 at the opposite end thereof so that the control pad can be inverted where the cryopump is to be mounted in an orientation inverted from that shown in FIG. 1. Also, an elastomeric foot 38 is provided on the flat upper surface of the electronics housing 26 to support the pump when inverted.

Figure 2:
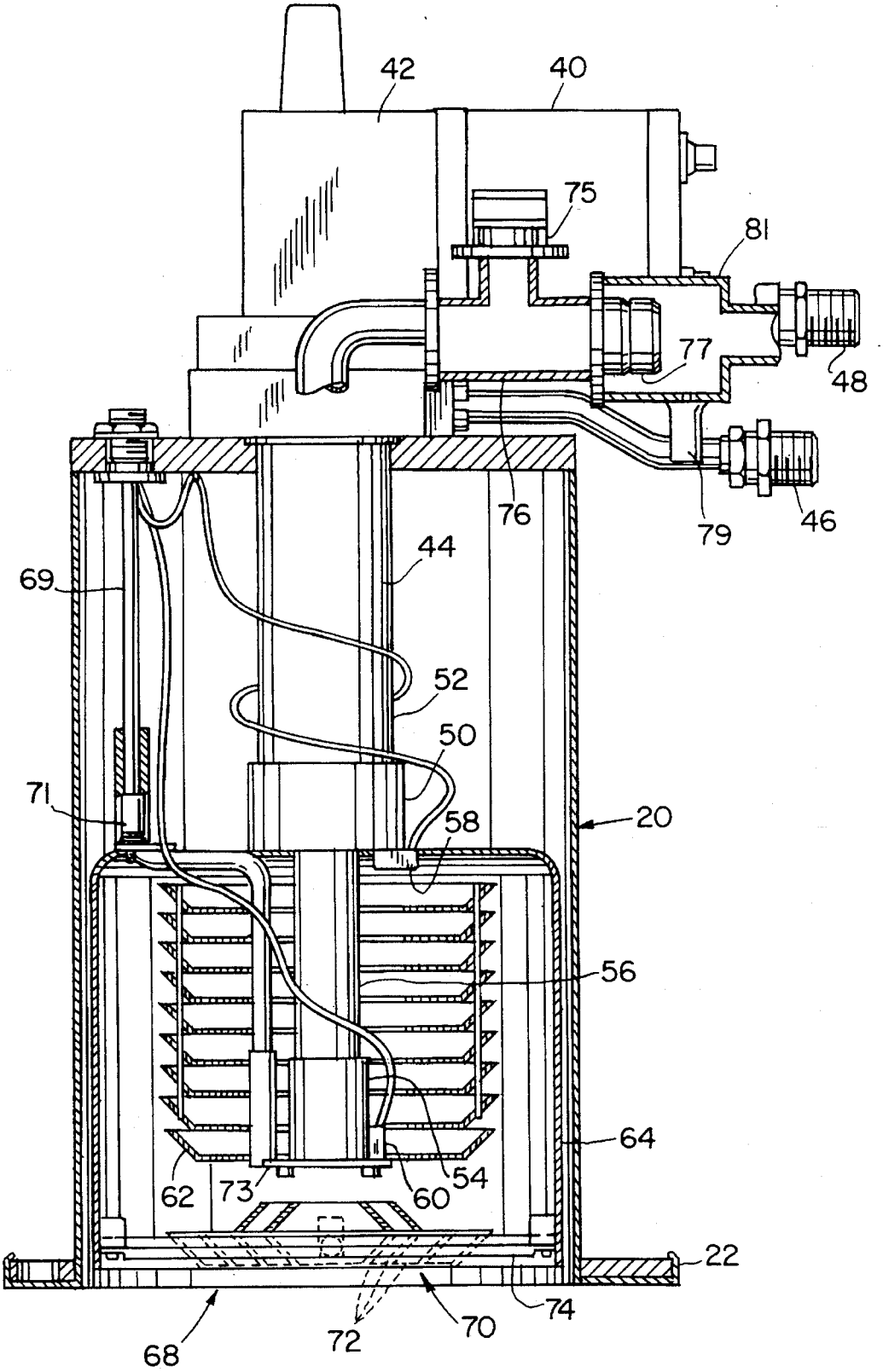
FIG. 2 is a cross-sectional view of the cryopump of FIG. 1 with the electronic module and housing removed.

As illustrated in FIG. 2, much of the cryopump is conventional. In FIG. 2, the housing 26 is removed to expose a drive motor 40 and a crosshead assembly 42. The crosshead converts the rotary motion of the motor 40 to reciprocating motion to drive a displacer within the two-stage cold finger 44. With each cycle, helium gas introduced into the cold finger under .pressure through line 46 is expanded and thus cooled to maintain the cold finger at cryogenic temperatures. Helium then warmed by a heat exchange matrix in the displacer is exhausted through line 48.

A first-stage heat station 50 is mounted at the cold end of the first stage 52 of the refrigerator. Similarly, heat station 54 is mounted to the cold end of the second stage 56. Suitable temperature sensor elements 58 and 60 are mounted to the rear of the heat stations 50 and 54.

The primary pumping surface is a cryopanel array 62 mounted to the heat sink 54. This array comprises a plurality of disks as disclosed in U.S. Pat. No. 4,555,907. Low temperature adsorbent is mounted to protected surfaces of the array 62 to adsorb noncondensible gases.

A cup-shaped radiation shield 64 is mounted to the first stage heat station 50. The second stage of the cold finger extends through an opening in that radiation shield. This radiation shield 64 surrounds the primary cryopanel array to the rear and sides to minimize heating of the primary cryopanel array by radiation. The temperature of the radiation shield may range from as low as 40 K. at the heat sink 50 to as high as 130 K. adjacent to the opening 68 to an evacuated chamber.

A frontal cryopanel array 70 serves as both a radiation shield for the primary cryopanel array and as a cryopumping surface for higher boiling temperature gases such as water vapor. This panel comprises a circular array of concentric louvers and chevrons 72 joined by a spoke-like plate 74. The configuration of this cryopanel 70 need not be confined to circular, concentric components; but it should be so arranged as to act as a radiant heat shield and a higher temperature cryopumping panel while providing a path for lower boiling temperature gases to the primary cryopanel.

Illustrated in FIG. 2 is a heater assembly 69 comprising a tube which hermetically seals electric heating units. The heating units heat the first stage through a heater mount 71 and a second stage through a heater mount 73.

Figure 3:
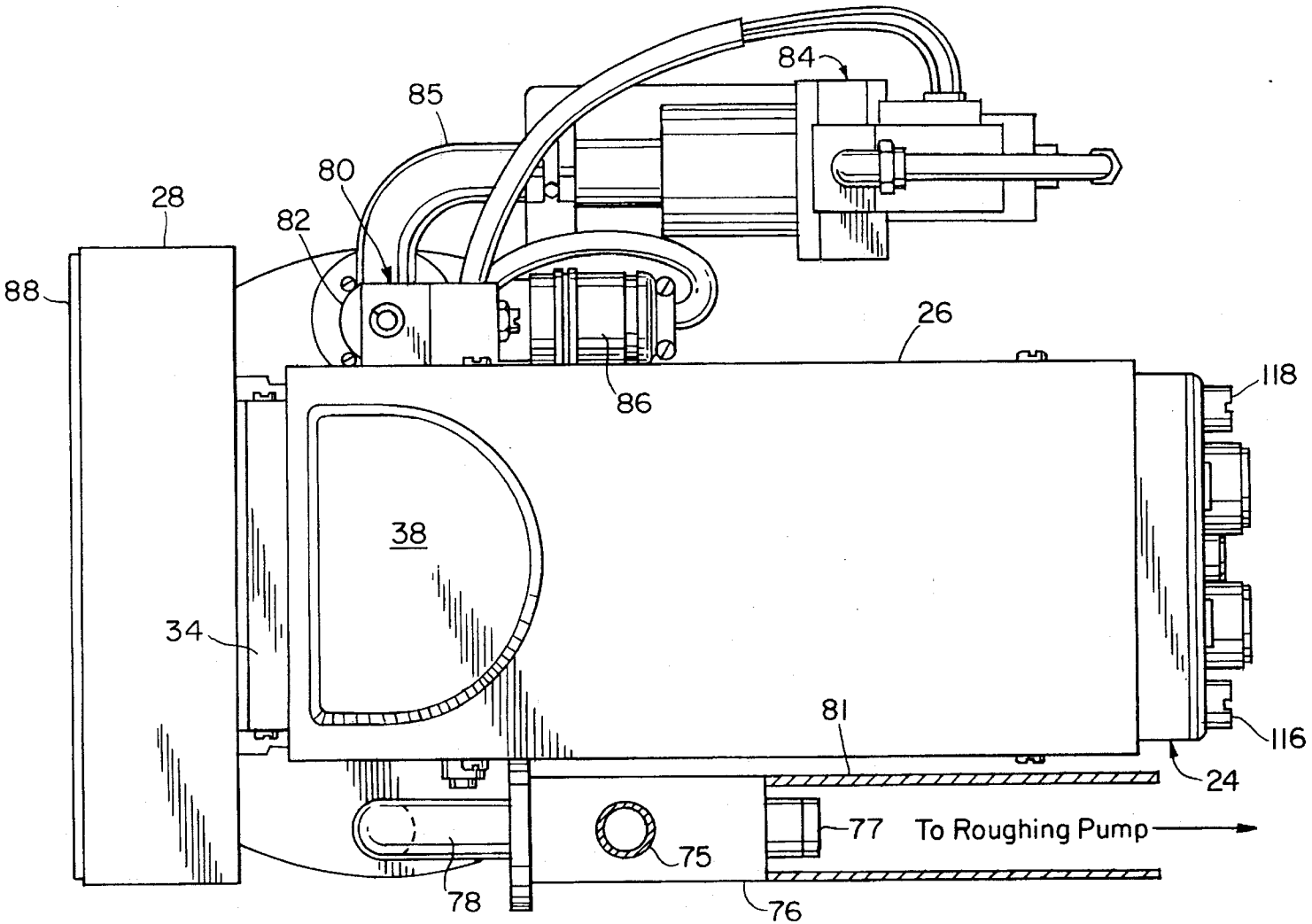
FIG. 3 is a top view of the cryopump of FIG. 1.
Figure 4:
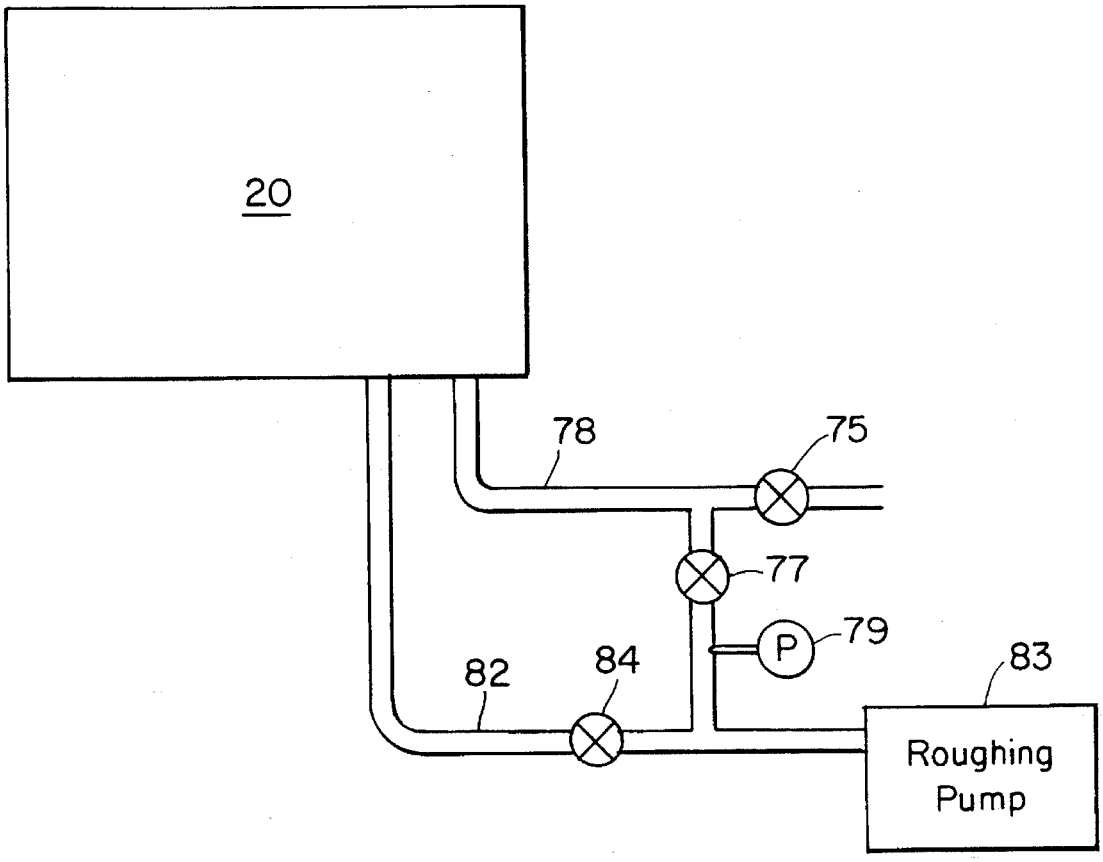
FIG. 4 is a schematic representation of the cryopump of FIG. 1 showing a subatmospheric relief valve and roughing valve ducted to a roughing pump.

As illustrated in FIGS. 1 and 3, a pressure relief valve assembly 76 is coupled to the vacuum vessel 20 through an elbow 78. The pressure relief valve assembly 76 comprises a standard atmospheric relief valve 75 in parallel with a subatmospheric relief valve 77. In accordance with the present invention, the subatmospheric relief valve 77 is ducted to a roughing pump 83 through pipe 81 (as shown in FIG. 4). A pressure sensor 79 is coupled to the interior of the pipe 81. To the other side of the motor and the electronics housing 26, as illustrated in FIG. 3, is an electrically actuated purge valve 80 mounted to the housing 20 through a vertical pipe 82. A thermocouple vacuum pressure gauge 86 is coupled to the interior of the chamber 20 through the pipe 82. Also coupled to the housing 20 through the pipe 82 and elbow 85 is an electrically actuated roughing valve 84. The roughing valve 84 is also ducted to the same roughing pump to which the subatmospheric relief valve 77 is ducted. FIG. 4 illustrates schematically the ducting of the subatmospheric relief valve 77 and the roughing valve 84 to the common roughing pump 83.

The refrigerator motor 40, cryopanel heater assembly 69, purge valve 80 and roughing valve 84 are all controlled by the electronic module. Also, the module monitors the temperature detected by temperature sensors 58 and 60 and the pressures sensed by the TC pressure gauge 86 and the pressure sensor 79.

Figure 5:
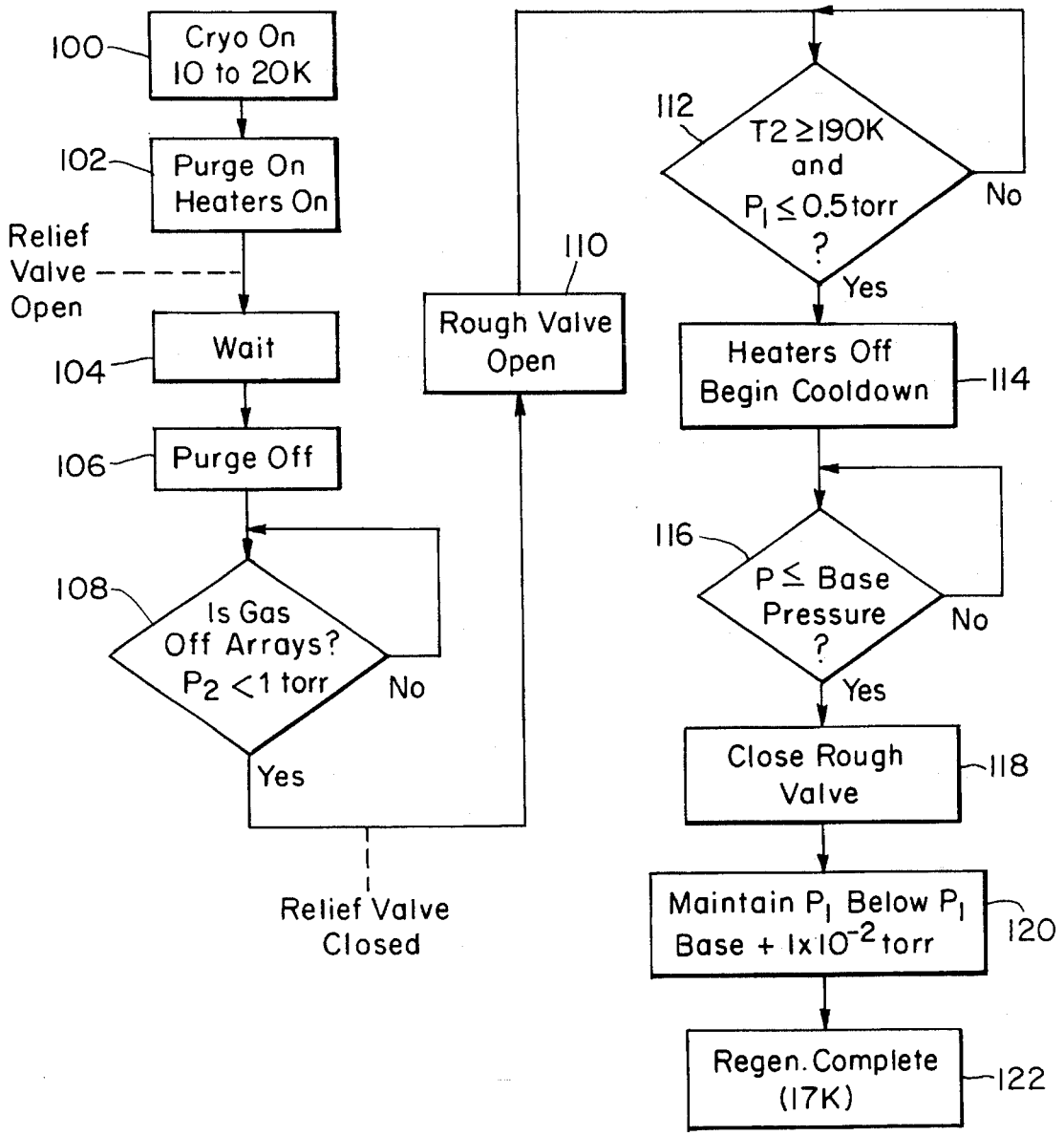
FIG. 5 is a flow chart of a subatmospheric regeneration procedure programmed into the electronic module.

To control a subatmospheric regeneration process, the electronic module is programmed as illustrated in FIG. 5.

Figure 6:
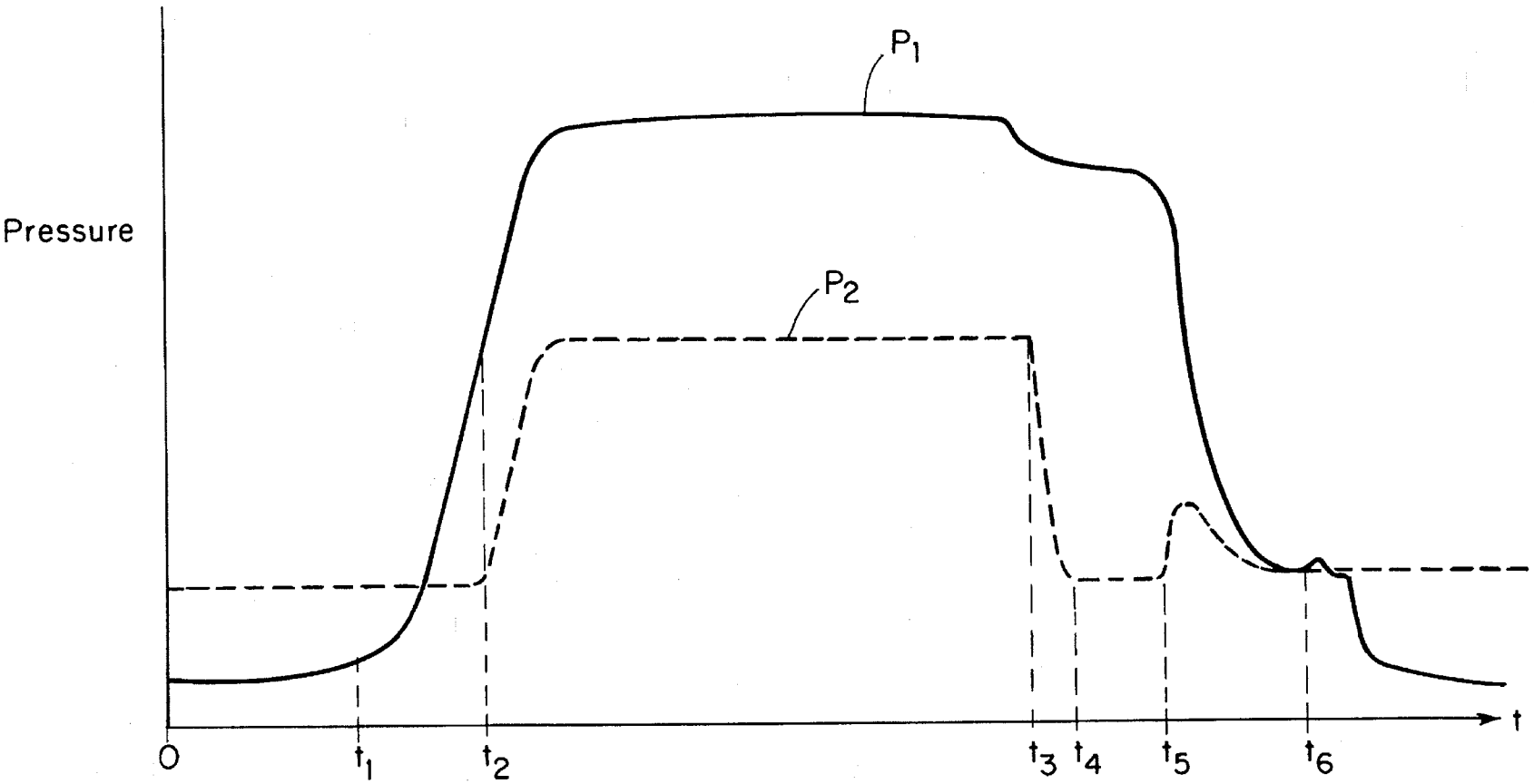
FIG. 6 is an illustration of cryopump pressure and line pressure over a regeneration cycle.

FIG. 6 illustrates the resultant cryopump pressure ($P_1$) and the line pressure ($P_2$) between the relief valve 77 and the roughing pump 83 over the regeneration cycle. Initially, the cryopump is operating normally at state 100 with the second stage temperature within the range of 10–20 K. To initiate the subatmospheric regeneration procedure, the system at 102 (time $t_1$ in FIG. 6) opens the purge valve 80 to introduce warm nitrogen purge gas and may turn on the heaters to the first and second stages. In a partial regeneration, only the second stage is heated. The cryogenic refrigerator continues to operate but its cooling effect is partially overcome by the heat applied. The purge is maintained for an initial period of, for example, two minutes.

The first stage is warmed to and held at about 110 K. to minimize collection of liquified gases thereon after the gases are released from the second stage. In partial regeneration, the first stage temperature is retained sufficiently low to avoid release of water vapor therefrom. The second stage temperature set point is set at a level between 175 K. and 200 K. The second stage is heated to greater than 175 K. to minimize contamination of the adsorbent with gases such as nitrogen and argon. The second stage is held to less than 200 K. to shorten the cool-down time. A preferred temperature set point is 190 K.

As gases begin to evolve and with introduction of purge gas in the cryopump chamber, the pressure differential between the cryopump pressure $P_1$ and the pressure $P_2$ in the pipe 81 leading to the roughing pump 83 rises sufficiently to open the relief valve 77 (time $t_2$). For one implementation of a subatmospheric regeneration process, the relief valve 77 opens at a pressure differential of about 380 torr. The pressure in the cryopump continues to rise as gases evolve and are removed by the roughing pump, and the pressure levels off at a subatmospheric maximum pressure in the range of about 520 to 600 torr. The system waits at 104 for a period of, for example, two minutes. At 106, the purge valve 80 is then turned off.

The relief valve 77 remains open to vent the evolving gases to the roughing pump 83. When the cryopump is sufficiently empty of released gases, the cryopump pressure drops and the relief valve 77 closes (time $t_3$). To determine when the pressure sensitive relief valve 77 closes, the system checks at 108 for a drop in the pressure in pipe 81. When the pressure in pipe 81 drops sufficiently, the relief valve 77 is determined to be closed (time $t_4$). The system then opens the roughing valve 84 to the roughing pump 83 at 110 (time $t_5$). Heat continues to be applied to the second stage to maintain the temperature of the second stage at 190 K. This reconditioning phase of the partial regeneration process continues until the second stage is heated to 190 K. and the pressure is reduced to 0.5 torr as indicated by the check at 112. Once these limits are reached, the heaters are turned off at 114 with the roughing valve 84 left open.

If at 116 the cryopump pressure has dropped to a base pressure level such as $5\times10^{-4}$ torr, then at 118 the roughing valve 84 is closed (time $t_6$). The base pressure at which the roughing valve 84 is closed is determined by the particular system, preferably in the range of $2.5\times10^{-2}$ to $2.5\times10^{-1}$ torr. Generally, the pressure is reduced to as low a level as possible without risking contamination of the adsorbent by oil backstreaming from the roughing pump 83.

The temperature of the second stage may be maintained at 190 K. until the pressure is reduced to the base pressure, but such an approach increases the cool-down time and thus the time of the overall regeneration process. It has been found that a reduction to only 0.5 torr before turning off the heaters is a good compromise.

Due to continued internal outgassing, the cryopump internal-pressure rises even as the cryopump continues to cool down. That pressure slows recooling and may rise high enough to prevent the recooling of the cryopump. In order to prevent this increase in pressure due to outgassing, the roughing valve 84 is cycled between limits near the base pressure at 120. Thus, when the pressure increases to $1\times10^{-2}$ torr above the base pressure, the roughing valve 84 is opened to draw the pressure back down to the base pressure. This keeps the pressure at an acceptable level and also provides further conditioning of the adsorbent by removal of additional gas. This approach of cycling the roughing valve may also be applied to rough pumping after full regeneration.

Once the second stage temperature has reached 17 K., the regeneration procedure is complete at 122.

While this invention has been particularly shown and described with references to preferred embodiments thereof, it will be understood by those skilled in the art that various changes in form and details may be made therein without departing from the spirit and scope of the invention as defined by the appended claims.

What is claimed is:

1. A method of regeneration of a cryopump comprising:

warming the cryopump to release gases from the cryopump;

opening a relief valve from the cryopump to a roughing pump at a first cryopump pressure level less than a predetermined maximum pressure;

maintaining the relief valve open until the cryopump is sufficiently empty of released gases;

closing the relief valve when the cryopump pressure drops below a second cryopump pressure level;

opening a roughing valve from the cryopump to the roughing pump after the relief valve closes.

2. A method as claimed in claim 1 further comprising the step of monitoring the closing of the relief valve to control opening of the roughing valve to the roughing pump.

3. A method as claimed in claim 2 wherein the step of monitoring comprises monitoring pressure in a line between the relief valve and the roughing pump to determine when the line pressure drops sufficiently to indicate that the relief valve has closed.

4. A method as claimed in claim 1 wherein the steps of opening and closing the relief valve are performed by a pressure-responsive relief valve.

5. A method as claimed in claim 1 wherein the steps are applied to a partial regeneration of a cryopump.

6. A method as claimed in claim 1 wherein the predetermined maximum pressure is subatmospheric,

7. A method of regeneration of a cryopump comprising:

warming the cryopump to release gases from the cryopump;

opening a relief valve from the cryopump to a vacuum pump at a first cryopump pressure level less than a predetermined maximum pressure;

maintaining the relief valve open until the cryopump is sufficiently empty of released gases;

closing the relief valve when the cryopump pressure drops below a second cryopump pressure level;

monitoring pressure in a line between the relief valve and the vacuum pump;

opening a roughing valve from the cryopump to a roughing pump after the line pressure drops sufficiently to indicate that the relief valve has closed,

8. A method as claimed in claim 7 wherein the vacuum pump is the roughing pump, 9. A method as claimed in claim 7 wherein the steps of opening and closing the relief valve are performed by a pressure-responsive relief valve, 10. A method as claimed in claim 7 wherein the steps are applied to a partial regeneration of a cryopump, 11. A method as claimed in claim 7 wherein the predetermined maximum pressure is subatmospheric, 12. A cryopump comprising:

a cryopump chamber;

a warm purge gas valve for applying purge gas to the cryopump chamber;

a roughing valve for coupling the cryopump chamber to a roughing pump;

a self-actuating relief valve for coupling the cryopump chamber to the roughing pump, the relief valve opening to the roughing pump at a first cryopump pressure level less than a predetermined maximum pressure and closing when the cryopump pressure drops below a second cryopump pressure level; and an electronic controller for controlling the purge gas valve and roughing valve, the controller being programmed to control a regeneration process by:

warming the cryopump to release gases from the cryopump;

opening the roughing valve to the roughing pump after the relief valve has closed.

13. The cryopump of claim 12 wherein the electronic controller is further programmed to control a regeneration process by monitoring the closing of the relief valve to control opening of the roughing valve to the roughing pump.

14. The cryopump of claim 13 further comprising a pressure sensor for monitoring pressure in a line between the relief valve and the roughing pump to determine when the line pressure drops sufficiently to indicate that the relief valve has closed.

15. The cryopump of claim 12 wherein the predetermined maximum pressure is subatmospheric.

16. A cryopump comprising:

a cryopump chamber;

a warm purge gas valve for applying purge gas to the cryopump chamber;

a roughing valve for coupling the cryopump chamber to a roughing pump;

a self-actuating relief valve for coupling the cryopump chamber to a vacuum pump, the relief valve opening to the vacuum pump at a first cryopump pressure level less than a predetermined maximum pressure and closing when the cryopump pressure drops below a second cryopump pressure level;

a pressure sensor for monitoring pressure in a line between the relief valve and the vacuum pump; and an electronic controller for controlling the purge gas valve and roughing valve, and for monitoring the pressure sensor, the controller being programmed to control a regeneration process by:

warming the cryopump to-release gases from the cryopump;

monitoring pressure in a line between the relief valve and the vacuum pump;

opening the roughing valve to the roughing pump after the line pressure drops sufficiently to indicate that the relief valve has closed.

17. The cryopump of claim 16 wherein the vacuum pump is the roughing pump.

18. The cryopump of claim 16 wherein the predetermined maximum pressure is subatmospheric.

19. A cryopump comprising:

at least first and second stages in a cryopump chamber cooled by a cryogenic refrigerator;

at least first and second heating elements for heating the cryopump stages;

a warm purge gas valve for applying purge gas to the cryopump chamber;

a roughing valve for coupling the cryopump chamber to a roughing pump;

a self-actuating relief valve for coupling the cryopump chamber to the roughing pump, the relief valve opening to the roughing pump at a first cryopump pressure level less than a predetermined maximum pressure and closing when the cryopump pressure drops below a second cryopump pressure level;

a pressure sensor for monitoring pressure in a line between the relief valve and the roughing pump; and an electronic controller for controlling the heating elements, purge gas valve, and roughing valve, and for monitoring the pressure sensor, the controller being programmed to control a regeneration process by:

warming the cryopump to release gases from the cryopump;

monitoring pressure in a line between the relief valve and the roughing pump;

opening the roughing valve to the roughing pump after the line pressure drops sufficiently to indicate that the relief valve has closed.

* * * * *